US010653233B2

(12) United States Patent
Casey

(10) Patent No.: US 10,653,233 B2
(45) Date of Patent: May 19, 2020

(54) HAIRBRUSH HAVING MANUAL ROTATING HANDLE

(71) Applicant: Cristi Casey, Oakhurst, CA (US)

(72) Inventor: Cristi Casey, Oakhurst, CA (US)

( * ) Notice: Subject to any disclaimer, the term of this patent is extended or adjusted under 35 U.S.C. 154(b) by 196 days.

(21) Appl. No.: 16/025,664

(22) Filed: Jul. 2, 2018

(65) Prior Publication Data

US 2020/0000214 A1 Jan. 2, 2020

(51) Int. Cl.

| | |
|---|---|
| ***A46B 5/02*** | (2006.01) |
| ***A46B 5/00*** | (2006.01) |
| ***A46B 9/02*** | (2006.01) |

(52) U.S. Cl.

CPC ..... *A46B 5/02* (2013.01); *A46B 5/0091* (2013.01); *A46B 9/023* (2013.01); *A46B 9/026* (2013.01); *A46B 2200/104* (2013.01)

(58) Field of Classification Search

CPC ..... A46B 5/02; A46B 5/0091; A46B 9/023; A46B 9/026; A46B 2200/104

See application file for complete search history.

(56) References Cited

U.S. PATENT DOCUMENTS

| | | | | |
|---|---|---|---|---|
| 1,622,834 | A | 6/1924 | Marcel | |
| 3,843,990 | A | 10/1974 | Lardenois | |
| 3,909,868 | A | 10/1975 | Nogues | |
| 3,947,910 | A | 4/1976 | Akerman | |
| 4,197,608 | A | 4/1980 | Holley et al. | |
| 4,604,514 | A | 8/1986 | Thaler et al. | |
| 4,656,684 | A | 4/1987 | Jewett | |
| 4,685,165 | A | 8/1987 | Fronius | |
| 5,479,951 | A * | 1/1996 | Denebeim | A45D 2/2478 132/120 |
| 5,502,860 | A | 4/1996 | Franke | |
| 5,511,270 | A | 4/1996 | Eliachar et al. | |
| 5,584,088 | A | 12/1996 | Pauldine | |
| 5,749,115 | A | 5/1998 | Franke | |

(Continued)

FOREIGN PATENT DOCUMENTS

| | | |
|---|---|---|
| GB | 2347342 A | 9/2000 |

OTHER PUBLICATIONS

Patent Cooperation Treaty, International Search Report, dated Sep. 11, 2019.

(Continued)

*Primary Examiner* — Weilun Lo

(74) *Attorney, Agent, or Firm* — Richard A. Ryan

(57) ABSTRACT

A hairbrush for use by a hairstylist to brush and style a person's hair. The hairbrush has a brush head, with a cylindrically-shaped elongated head body, and an elongated handle that is attached to the head body so as to extend rearwardly therefrom. The head body has a plurality of bristles extending outward along its length and circumference. The handle has a first handle assembly and a spaced apart, parallel second handle assembly. Each handle assembly has an elongated rod member and an elongated sleeve disposed about its associated rod member. A first connector attaches the rod members to a base of the head body. A second connector joins the two handle assemblies together to stiffen the handle. In use, the hairstylist uses the palm area of the hand to rotate the two handle assemblies, which rotates the brush head, to reduce strain on the hairstylist's thumb, fingers and wrist.

20 Claims, 2 Drawing Sheets

(56) References Cited

U.S. PATENT DOCUMENTS

| | | | | |
|---|---|---|---|---|
| 5,887,600 | A | 3/1999 | Wilk | |
| 6,230,716 | B1 * | 5/2001 | Minoletti | A45D 6/04 132/120 |
| 6,604,532 | B1 | 8/2003 | McClendon et al. | |
| 7,654,269 | B1 * | 2/2010 | Boyle | A46B 5/00 132/120 |
| 8,215,319 | B2 | 7/2012 | Couillard | |
| 2008/0263798 | A1 * | 10/2008 | Belmonte | A46B 5/002 15/106 |
| 2009/0070951 | A1 * | 3/2009 | Sever | A46B 5/002 15/143.1 |
| 2010/0236571 | A1 | 9/2010 | Haziza | |
| 2013/0133683 | A1 * | 5/2013 | Guthans | A45D 6/04 132/237 |
| 2016/0286950 | A1 * | 10/2016 | DiPippo | A46B 17/06 |
| 2018/0220784 | A1 * | 8/2018 | Difede | A46B 9/023 |

OTHER PUBLICATIONS

Patent Cooperation Treaty, Written Opinion of the International Searching Authority, dated Sep. 11, 2019.

* cited by examiner

HAIRBRUSH HAVING MANUAL ROTATING HANDLE

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to hairbrushes that are utilized to brush, curl and otherwise style a person's hair. In particular, the present invention relates to hairbrushes that are configured to allow the user to easily, effectively and efficiently style his or her hair or another person's hair, specially while also blow drying the hair. Even more particularly this invention relates to such hairbrushes that have a handle which can be rotated separately from the brush head to reduce stress and fatigue on the user's wrist and hand.

B. Background

For many years, people have utilized hairbrushes to brush, curl and otherwise style their own hair or another person's hair. The typical hairbrush has a brush head that is attached to or integrally formed with a handle. The brush head has a head body with a plurality of bristles that extend outwardly from the head body. The head body may be solid or hollow and made out of wood, plastic or a wide variety of other materials. The bristles, which are commonly made out of plastic or the like, are often provided in a bristle pattern that is specially configured to achieve certain hair styling benefits. The handle is sized and configured to be grasped by the person who will be utilizing the brush to brush a person's hair, whether their own hair or someone else's hair. For conventional hairbrushes, the handle may be solid or hollow and it may be made out of a wide variety of different materials, including wood, plastic, metal or the like. Typically, the materials utilized for the components of a hairbrush are selected for durability, stiffness (as may be applicable) and, preferably, ability to produce a lightweight hairbrush.

One common configuration for a hairbrush is for the hairbrush to have a cylindrically shaped brush head with the bristles extending outward from the head body circumferentially around the surface of the head body. These hairbrushes are commonly referred to as cylindrical hairbrushes. Examples of cylindrical hairbrushes are shown in U.S. Pat. No. 3,843,990 to Lardenois and U.S. Pat. No. 3,909,868 to Nogues. Although there is no single configuration for cylindrical hairbrushes, many of these hairbrushes have a plurality of spaced apart groups of bristles or have a plurality of spaced apart individual bristles that extend through a hub-shaped head body. The head body and the bristles may be of any size and shape, with the bristles typically extending outwardly from all or substantially all of the head body of the brush head.

As well known in the relevant art, hairstylists often utilize cylindrical hairbrushes when they are styling a person's hair during the point of the styling process when the hairstylist is also blow drying the person's hair so as to create and fix the desired look for the person. For purposes of the describing the present invention, the term "hairstylist" is utilized to refer to any person who is preparing a person's hair, including their own hair. A typical configuration for such hairbrushes is that the handle is fixedly attached to the brush body of the brush head. When a hairstylist uses a cylindrical brush while styling and drying hair, the hairstylist will roll a portion of the damp hair in the bristles of the cylindrical brush head, turn the hairbrush in the desired direction (either towards or away from the person's head) to wrap the hair around the brush head and then apply heat to dry the hair while the hair is in the rolled condition using, typically, a hand-held blow dryer. The handle of the hairbrush is twisted in the opposite direction to release the hair from the bristles of the brush head. This styling action require the hairstylist to rotate the handle for each rotation of the brush head, typically using the thumb and fingers of the hairstylist's hand. As well known, the above-described movement of the hairbrush frequently results in uncomfortable strain on and the potential for injury to the hairstylist's wrist and hand.

Due to the styling benefits of using a cylindrical hairbrush, there have been a number of prior art attempts to overcome the strain and injury problems associated with using cylindrical hairbrushes while still retaining those benefits. For instance, U.S. Pat. No. 3,909,868 to Nogues discloses a hairbrush having a cylindrical hub head body and an axial shaft on which the cylindrical hub is rotated. The hairbrush has a handle and a operating knob, one of which is attached to the hub and the other of which slides into and out of engagement with the hub to prevent or allow rotating of the hub relative to the handle. U.S. Pat. No. 3,947,910 describes an automatic hairbrush with a handle and a rotatable axle bearing radially extending bristles. A spring mechanism inside the hollow handle accumulates rotational energy when the hairstylist pulls on the handle so the energy can be released to allow the brush head to rotate in the opposite direction to roll the hair up in the bristles. U.S. Pat. No. 4,656,684 to Jewett describes a hairbrush having a brush head and handle that are configured to rotate relative to each other along a common longitudinal axis. A locking/releasing means allows selective relative rotation of the brush head and handle. U.S. Pat. No. 4,685,165 to Fronius discloses a hairbrush having a brush head that rotates relative to a handle. Relative rotation is reduced or prevented by applying force with a finger or thumb against a braking component associated with the brush head. U.S. Pat. No. 5,749,115 to Franke discloses a rotatable head hairbrush having a hollow handle in which is received a spring blade that connects to the brush head and a rotation locking mechanism selectively allows or prevents rotation of the spring blade in the handle, which allows or prevents rotation of the brush head relative to the handle. U.S. Patent Publication No. 2010/0236571 to Haziza discloses a hairbrush having a handle, brush head and a coupling mechanism that joins the brush head to the handle in a manner which allows the brush head to rotate separate from the handle. U.S. Pat. No. 8,215,319 to Couillard describes a hairbrush having a brush head releasably connected to a rod rotatably mounted on a handle. The hairbrush is configured to allow the brush head to rotate as the handle is moved toward the head of the person whose hair is being styled without requiring twisting of the handle.

In addition to the above, there are cylindrical and other hairbrushes that utilize motorized rotation of the brush head or the handle to achieve the benefits of a rotating hairbrush. Due to the weight of the motor, some of these hairbrushes are generally considered too heavy for most hairstylist to effectively utilize. In addition, the electrically motorized rotating hairbrushes, having cylindrical or other shaped brush heads, are generally not suitable for use in a hair salon due to the hairbrush sanitation requirements.

Despite the foregoing and other prior art, most of which are not in use and/or are not readily available to hairstylists, what is needed is an improved hairbrush that is configured to allow the hairstylist to style a person's hair in a manner that reduces the strain on the hairstylist's hand and wrist. More specifically, what is needed is a hairbrush that has a cylindrical brush head that is configured to allow the hairstylist to rotate the brush head in a person's hair in a manner that reduces the strain on the hairstylist's hand, particularly his or her thumb and fingers, and wrist. The new hairbrush should be adaptable for use with a wide range of different types and sizes of brush head designs, including those brush heads having different patterns, groups, types and lengths of bristles. The new hairbrush should be particularly configured to be beneficial for use to assist a hairstylist with styling a person's hair while he or she is also utilizing a hand-held blow dryer to dry the hair. In the preferred configurations, the new hairbrush should be configured to be easy to use, relatively inexpensive to manufacture and able to be disinfected.

SUMMARY OF THE INVENTION

The hairbrush of the present invention provides the benefits and solves the problems identified above. That is to say, the hairbrush of the present invention is specially structured and arranged to allow a hairstylist to style a person's hair in a manner that reduces the stress and strain on his or her hand and wrist and, therefore, reduces the likelihood of repetitive type injuries to the hairstylist. More specifically, the new hairbrush is configured to allow a hairstylist to quickly, easily and efficiently utilize the hairbrush to style a person's hair by primarily utilizing the palm of his or her hand to rotate a portion of the handle to rotate the brush head in the person's hair, thereby reducing the need to rely on his or her thumb, fingers and wrist to rotate the brush head. The new hairbrush of the present invention has a specially configured handle that is attached to a cylindrical brush head in a manner that allows the hairstylist to rotate the cylindrical brush head in a person's hair with much less strain on the hairstylist's hand, particularly his or her thumb and fingers, and wrist. The new hairbrush is readily adaptable for use with a wide range of different types and sizes of brush head designs, such as brush heads which have different bristle patterns, groupings, types and lengths so the hairbrush can meet the brush needs and benefits of all hairstylists. The new hairbrush is particularly beneficial for use by a hairstylist who is styling a person's hair while also utilizing a hand-held blow dryer to dry the hair. The hairbrush of the present is easy to learn to use, beneficial for allowing the hairstylist to achieve a wide variety of different hair styles and, in the preferred configurations, relatively inexpensive to manufacture.

In one embodiment of the present invention, the hairbrush generally comprises a brush head and a handle. The brush head has a head body with a plurality of bristles that extend outwardly from the head body. The head body has a first end and a second end, with the first end of the head body defining a first end of the hairbrush. The handle has a first end and a second end, with the first end of the handle positioned at the second end of the head body of the brush head. The second end of the handle defines a second end of the hairbrush. The handle of the new hairbrush comprises a first handle assembly and a second handle assembly, which is disposed in spaced apart relation to the first handle assembly so as to define a gap between the two handle assemblies. Each of the handle assemblies have a rod member and a tubular sleeve that is disposed around the rod member, with the handle assemblies being structured and arranged for the rod member to be fixedly associated with the head body and for the sleeve to rotate relative to the rod member. In use, the rotation of each of the first handle assembly and the second handle assembly by the palm area of the hairstylist's hand rotates the brush head to allow the hairstylist to brush and/or style a person's hair without strain on his or her thumb, fingers and wrist. In a preferred configuration, the head body of the brush head has an elongated cylindrical shape and the bristles are disposed substantially along the entire length and circumference of the head body. The head body of the brush head has an elongated head axis and the handle is configured to define an elongated handle axis, such that the elongated head axis and the elongated handle axis collectively define a longitudinal brush axis through the hairbrush.

In a preferred embodiment of the new hairbrush, each of the rod members are elongated and define an elongated rod axis, the elongated rod axis of the first handle assembly is parallel to and in spaced apart relation to the elongated rod axis of the second handle assembly, with the rod axis of the first handle assembly and the second handle assembly being parallel to and in spaced apart relation to a longitudinal brush axis through the head body and the handle. In one configuration, the rod member of each of the first handle assembly and the second handle assembly is integral with or attached to the head body of the head brush. In another configuration, each of the rod members are attached to or integral with a base of the head body. The preferred embodiment of the new hairbrush also comprises a first connector that is structured and arranged to interconnect the first end of the handle with the second end of the head body. In one configuration, the first connector attaches each of the rod members of the two handle assemblies with a base of the head body. The hairbrush can also have a second connector disposed at or near the second end of the handle, with the second connector being structured and arranged to join the first handle assembly and the second handle assembly. In one configuration, the second connector is configured to connect the rod member of the first handle assembly to the rod member of the second handle assembly, thereby allowing the sleeves of each of the handle assemblies to freely rotate.

Accordingly, the primary object of the present invention is to provide a new hairbrush that has the advantages set forth above and which overcomes the various disadvantages and limitations which are commonly associated with presently available hairbrushes, particularly cylindrical hairbrushes.

It is an important object of the present invention to provide a new hairbrush that is specifically structured and arranged to reduce the strain and potential for repetitive motion type injuries for a hairstylist who utilizes a hairbrush to style a person's hair.

An important aspect of the present invention is that it provides a new hairbrush which accomplishes the objectives set forth above and elsewhere in the present disclosure.

Another important aspect of the present invention is that it provides a new hairbrush which is structured and arranged to be utilized by a hairstylist to style a person's hair in a manner that reduces strain on the hairstylist's hand and wrist and, as such, significantly reduces the likelihood of repetitive motion types of hand injuries for the hairstylist.

Another important aspect of the present invention is that it provides a new hairbrush having a brush head and a handle attached to the brush head that are cooperatively structured and arranged to allow a hairstylist to rotate the brush head in a person's hair without having to entirely rely on, and therefore strain, his or her thumb, fingers and wrist to accomplish the desired rotation.

Another important aspect of the present invention is that it provides a new hairbrush which is specially structured and arranged to be beneficially utilized by a hairdresser to style a person's hair while he or she is also using a blow dryer to dry the person's hair.

Another important aspect of the present invention is that it provides a new hairbrush which is utilized by a hairstylist to quickly, easily and efficiently brush and style a person's hair, with the hairbrush being configured to allow the hairstylist to primarily use the palm of his or her hand, instead of the thumb, fingers and wrist, to rotate a portion of the handle of the hairbrush and, therefore, to rotate the brush head in the person's hair to accomplish the desired styling task.

Another important aspect of the present invention is that it provides a new hairbrush having a specially configured handle which is operatively attached to a cylindrical brush head in a manner that allows the hairstylist to rotate the brush head in a person's hair with much less strain on his or her hand.

Another important aspect of the present invention is that it provides a new hairbrush, having a manual rotating handle, which is easy to clean and disinfect.

Another important aspect of the present invention is that it provides a new hairbrush which is adaptable for use with a wide range of different types and sizes of brush head designs.

Yet another important aspect of the present invention is that it provides a new hairbrush which is easy to learn to use, beneficial for allowing the hairstylist to achieve a wide variety of different hair styles and, in the preferred configurations, relatively inexpensive to manufacture.

As will be explained in greater detail by reference to the attached figures and the description of the preferred embodiments which follow, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the hairbrush of the present invention, as well as one or more examples of how the new hairbrush may be utilized, those skilled in the art will readily appreciate that the present invention is not so limited. In addition, the exemplary embodiments of the present hairbrush is shown and described herein with only those components that are required to disclose the present invention. As such, it may be possible that some of the necessary elements for attaching and using the present invention are not shown or necessarily described below, but which are well known to persons who are skilled in the relevant art. As will be readily appreciated by such persons, the various elements of the present invention that are described below may take on any form consistent with forms that are readily realized by a person of ordinary skill in the art having knowledge of hairbrushes and rotatably configured handles.

Figure 1:
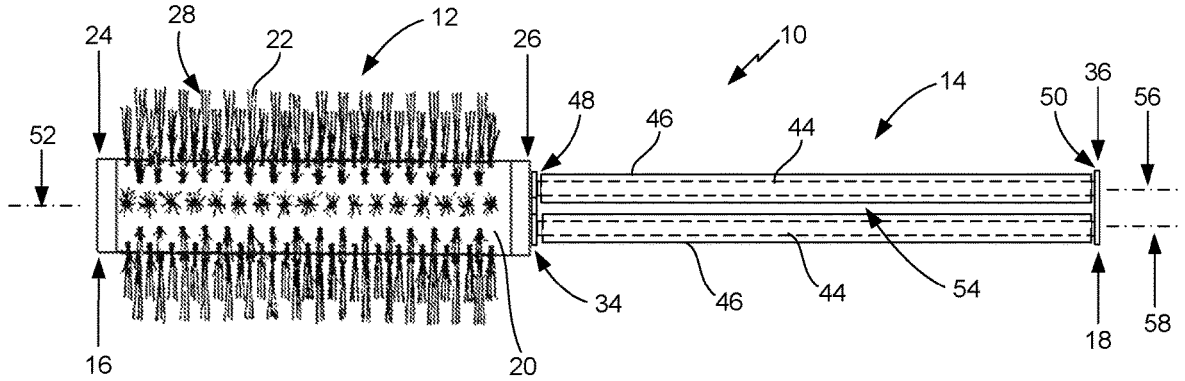
FIG. 1 is a top view of a hairbrush that is configured according to one of the preferred embodiments of the present invention, with the hairbrush shown having a cylindrically-shaped brush head.
Figure 2:
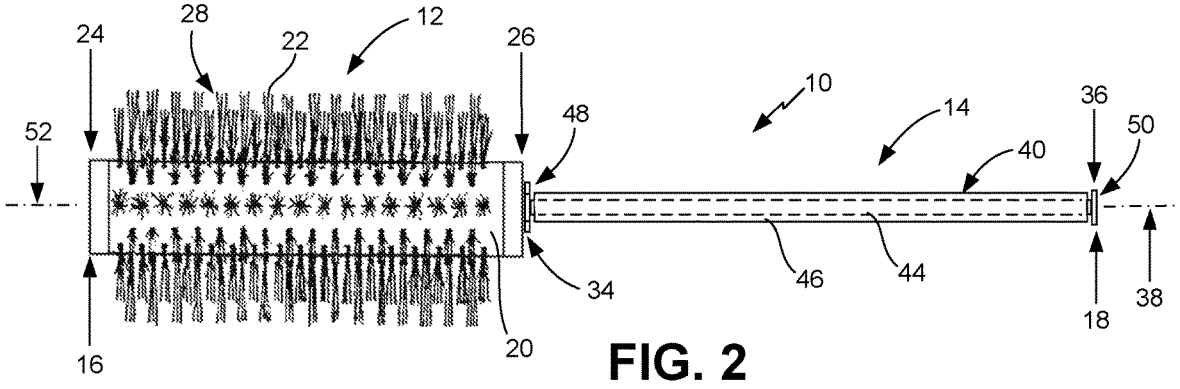
FIG. 2 is a side view of the hairbrush of FIG. 1.
Figure 3:
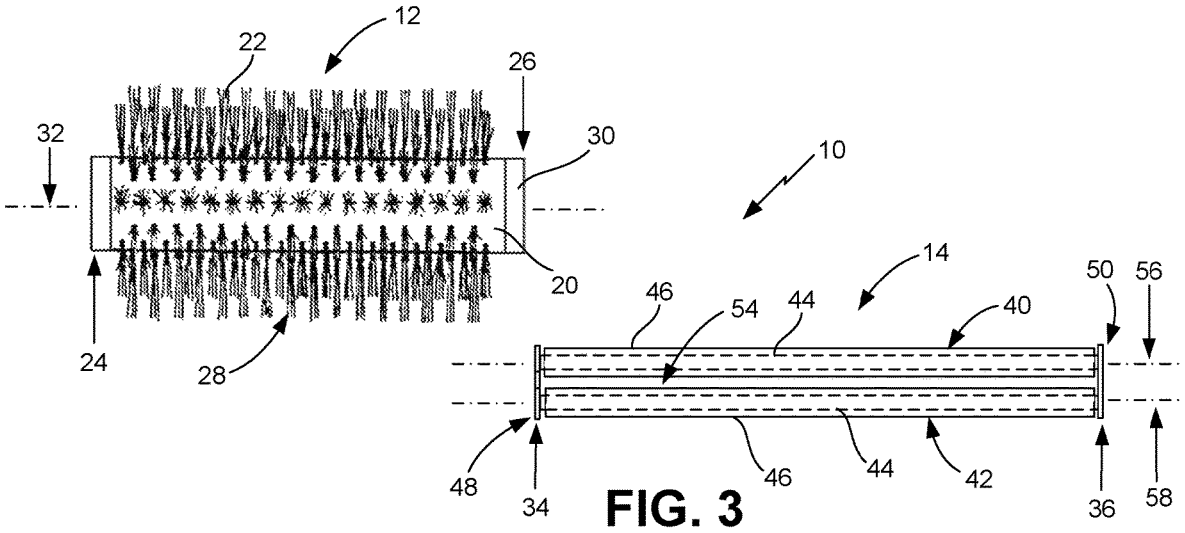
FIG. 3 is a top view of the hairbrush of FIG. 1 showing the brush head separate from and offset from the handle.
Figure 4:
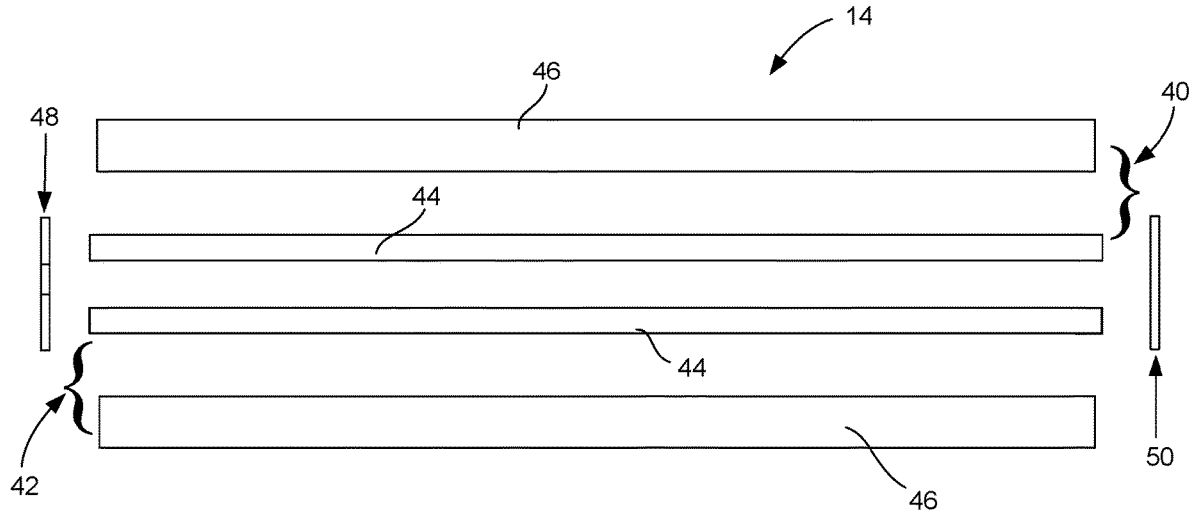
FIG. 4 is an exploded view of the handle of the hairbrush of FIG. 3.

A hairbrush that is configured pursuant to one or more of the preferred embodiments of the present invention is referred to generally as 10 in FIGS. 1-4. As set forth below, in a preferred embodiment of the present invention, the new hairbrush 10 generally comprises a brush head 12 and a handle 14 that are joined together, either by portions thereof being integrally formed or by being operatively attached to each other. As best shown in FIG. 1-3, the brush head 12 defines a first end 16 of the hairbrush 10 and the handle 14 defines a second end 18 of the hairbrush 10. As will be set forth in more detail below, the new hairbrush 10 of the present invention is beneficially utilized by a hairstylist, which may be any person who is brushing and/or styling his or her hair or, perhaps more likely, to brush and/or style another person's hair. As well known to persons who are skilled in the relevant art, the brush head 12 is structured and arranged to engage the person's hair and the handle 14 is structured and arranged to be held in the hairstylist's hand while he or she is brushing and/or styling the person's hair. As also well known, very often it is beneficial for the hairstylist to utilize a hairbrush while he or she is also drying the person's hair, typically by using a hand-held blow dryer. As set forth in more detail below and which will be readily apparent to persons who are skilled in the art, the hairbrush 10 of the present invention is particularly configured to be beneficially utilized by a hairstylist to brush and style a person's hair while the hairstylist is also blow drying the hair.

The brush head 12 has a head body 20 with a plurality of bristles 22 that extend outwardly from the head body 20. The head body 20, which may be solid or hollow and made out of wood, plastic or a wide variety of other materials, has a forward or first end 24 that, typically, corresponds to the first end 16 of the hairbrush 10 and a rearward or second end 26 that, typically, corresponds to the second end 18 of the hairbrush 10, as best shown in FIGS. 1-3. The bristles 22, which are commonly made out of plastic or the like, are often provided in a bristle pattern that is specially configured to achieve certain hair styling benefits. As shown in FIGS. 1-3, the bristles 22 may be grouped together in a plurality of bristle groups 28 that are positioned along the head body 20. For a cylindrically-shaped head body 20, which forms the cylindrical hairbrush 10 with handle 14, the bristle groups 28 are positioned both lengthwise and circumferentially on the head body 20. For purposes of describing the hairbrush 10 of the present invention, the head body 20 has a base 30, with rearwardly facing handle engaging surface, to which the handle 14 is integrally formed with the head body 20 or attached to head body 20. As set forth in more detail below, in a preferred embodiment of the hairbrush 10 of the present invention (such as that shown in FIGS. 1-3), handle 14 is attached to the head body 20. For use with hairbrush 10 of the present invention, a cylindrically shaped head body 10 having bristles 22 extending substantially entirely along the length and entirely circumferentially around the head body 20 is preferred. In the preferred configuration, the head body 10 is elongated and has a longitudinal head axis 32 therethrough, as shown in FIG. 3.

The handle 14 is sized and configured to be comfortably grasped and manipulated by the hairstylist who will be utilizing the hairbrush 10 of the present invention to brush a person's hair. To provide the benefits of the hairbrush 10 of the present invention, namely the ability to utilize the hairbrush 10 to brush and/or style a person's hair with less strain on the hairstylist's thumb, fingers and wrist, the handle 14 is structured and arranged to allow the hairstylist to more easily rotate the brush head 12 when the bristles 22 thereof are engaged in the person's hair. The elongated handle 14 has a forward or first end 34, a rearward or second end 36 and a longitudinal handle axis 38, as best shown in FIGS. 1-3. The handle 14 of hairbrush 10 comprises a first handle assembly 40 and a second handle assembly 42 that are positioned in spaced apart relation to each other, as shown in FIGS. 1 and 3. Each of the first handle assembly 40 and the second handle assembly 42 have an elongated rod member 44 and an elongated sleeve 46, as shown in FIGS. 1-4. As set forth in more detail below, the rod members 44 are integral with or fixedly attached, directly or indirectly, to the head body 20. In the embodiment shown in the figures, the hairbrush 10 utilizes a forward or first connector 48 at the first end 34 of the handle 14 that attaches the rod members 44 to the base 30 of the head body 20 and a rearward or second connector 50 that joins the two handle assemblies 40/42 together, as best shown in FIGS. 1-3. In other embodiments, the handle assemblies 40/42 may be attach to the head body 20 without the use of the first connector 48 and the two handle assemblies 40/42 may be joined, if at all, by the second connector 50 at a position other than the second end 36 of the handle 14 (i.e., somewhere between the first end 34 and second end 36) and/or more than one second connector 50 may be utilized. As set forth in more detail below, in any configuration, the rod members 44 will need to be fixedly associated with the head body 20 and each of the sleeves 46 will need to rotate relative to their respective rod member 44. In a preferred configuration of the new hairbrush 10, the longitudinal head axis 32 and the longitudinal handle axis 38 are aligned to define the longitudinal brush axis 52 shown in FIGS. 1-2.

The components of handle 14 may be made out of a wide variety of different materials, including wood, plastic, metal or the like. Typically, the materials utilized for the components of a handle 14 will be selected for durability, stiffness and, preferably, their ability to provide a lightweight hairbrush 10. The rod members 44 of the two handle assemblies 40/42 can be solid or hollow. The sleeve members 46 of the two handle assemblies 40/42 will need to be tubular shaped to allow the sleeve members 46 to be positioned over and rotate relative to their respective rod member 44. As shown in the figures, in one configuration the rod members 44 will be longer than the sleeves 46 so the rod members 44 can attach to the base 30 or to the connectors 48/50 in a manner that allows the sleeves 46 to rotate relative to the rod members 44. As set forth above, the two handle assemblies 40/42 are positioned in spaced apart relation to each other so as to define a gap 54 between the two handle assemblies 40/42, as shown in FIGS. 1 and 3. The gap 54, which can be very small, is provided to allow the sleeve 46 of each of the handle assemblies 40/42 to be able to rotate relative to each other when the hairbrush 10 is in use to brush and/or style hair.

Figure 5:
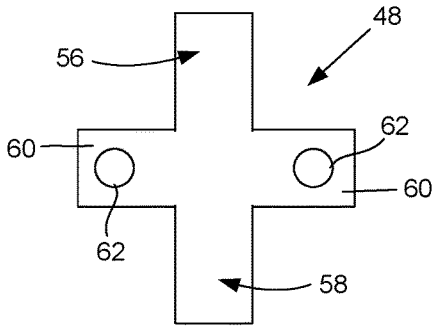
FIG. 5 is a top view of the first or forward connector of the handle of FIG. 4.

As set forth above, the embodiment of the hairbrush 10 of the present invention utilizes a first connector 48 at the first end 34 of the handle 14 to attach the rod members 44 of each of the handle assemblies 40/42 to the head body 20 to fixedly associate the handle assemblies 40/42, and therefore the handle 14, with the brush head 12, as best shown in FIGS. 1-3. The first connector 48, shown separately in FIG. 5, has a first section 56 and a second section 58. The rod member 44 of the first handle assembly 40 is integrally formed or (typically) attached to the first section 56 of the first connector 48 using adhesives or connecting elements (not shown) such as nails, screws or the like. The rod member 44 of the second handle assembly 42 is integrally formed or (typically) attached to the second section 58 of the first connector 48 using adhesives or connecting elements (not shown) such as nails, screws or the like. The first connector 48, having the handle 14 attached thereto, is then attached to the head body 20 of the brush head 12. In the configuration of the first connector 48 shown in FIG. 4, the first connector 48 has a pair of laterally disposed wing members 60 that each have an aperture 62 that allows the first connector 48, and therefore the handle 14, to be attached to the brush head 12. The first connector 48 can then be connected to the base 30 of the head body 20 using connecting elements such as nails, screws, bolts or the like or, depending on the materials, by welding or like processes.

Figure 6:
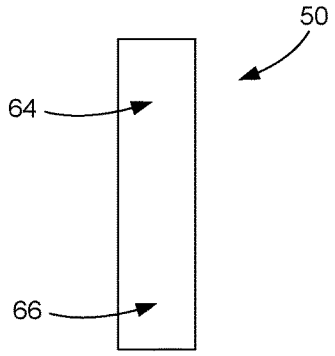
FIG. 6 is a top view of the second or rearward connector of the handle of FIG. 4.

As also set forth above, the rod members 44 of each handle assembly 40/42 are joined together to connect the two handle assemblies 40/42 in a manner that provides a more rigid and sturdy handle 14. In the embodiment shown in the figures, the second connector 50, which is shown separately in FIG. 6, has a first section 64 and a second section 66. The rod member 44 of the first handle assembly 40 is integrally formed or (typically) attached to the first section 64 of the second connector 50 using adhesives or connecting elements (not shown) such as nails, screws or the like. The rod member 44 of the second handle assembly 42 is integrally formed or (typically) attached to the second section 66 of the second connector 48 using adhesives or connecting elements (not shown) such as nails, screws or the like.

As will be readily appreciated by persons skilled in the art, a wide variety of different types and configurations of connectors 48/50 can be utilized to connect the rod members 44 of the handle assemblies 40/42 to the head body 20 of the brush head 12. Alternatively, the hairbrush can be configured in a manner such that the first connector 48 is not needed to connect the handle assemblies 40/42 to the head body 20 and/or the second connector 50 is not needed to join the two handle assemblies 40/42 together (i.e., the handle assemblies 40/42 may be sufficiently rigid not need to be connected).

The hairbrush 10 of the present invention may also include a coupling mechanism interconnecting the rod member 44 and sleeve 46 of one or more, usually both, of the handle assemblies 40/42 of handle 14. In one embodiment, the coupling mechanism may be a needle bearing or other type of bearing at or near each end 34/36 of the handle 14. In another embodiment, the coupling mechanism can be a needle bearing or other type of bearing at only one of the ends 34/36 or between the ends 34/36 of the handle 14. Alternatively, the rod member 44 and sleeve 46 may be coupled together by other means that are well known in the relevant art. Examples of various coupling mechanisms utilized in the prior art are shown and described in U.S. Patent Publication No. 2010/0236571 to Haziza, U.S. Pat. No. 1,622,834 to Marcel (the "Marcel Curling Iron"), U.S. Pat. No. 4,604,514 to Thaler, et al., U.S. Pat. No. 4,685,165 to Fronius, U.S. Pat. No. 5,511,270 to Eliachar, et al., U.S. Pat. No. 6,604,532 to McClendon, et al. and U.S. Pat. No. 8,215,319 to Couillard. The disclosure of the above-identified patent publications and patents are incorporated herein as though fully set forth in the present disclosure. In a preferred configuration, no coupling mechanism is utilized, allowing the sleeve 46 of each of the handle assemblies 40/42 to rotate freely around the rod members 44 thereof.

Each of the elongated rod members 44 have an elongated rod axis, shown as first elongated rod axis 56 and second elongated rod axis 58 in FIGS. 1 and 3. As shown in these figures, the elongated rod axis 56 of said first handle assembly 40 is parallel to and in spaced apart relation to the elongated rod axis 58 of the second handle assembly 42. The first elongated rod axis 56 of the first handle assembly 40 and the second elongated rod axis 58 of the second handle assembly 42 are parallel to and in spaced apart relation to the longitudinal brush axis 52 through the head body 20 of the brush head 12 and the handle 14.

In use, the hairstylist will grasp the two handle assemblies 40/42 that form the handle 14, which are sized and configured such that the width or diameter of the handle 14 will fit within the general area of the palm of the hairstylist's hand. When the hairstylist engages the person's hair with the brush head 12 of the new hairbrush 10 and a portion of the hair is engaged by the bristles 22, the hairstylist will rotate the head body 12 by using the palm area of his or her hand to provide a squeezing motion that rotates each of the handle assemblies 40/42. The motion of turning the cylindrically-shaped brush head 12 is accomplished by the hairstylist's hand rotating the two handle assemblies 40/42, which handle assemblies 40/42 are positioned in close proximity to each other, by squeezing the handle 14 in his or her hand to move one handle assembly 40/42 over the other. This motion can be performed while keeping the hairstylist's wrist straight or at least substantially straight, which will reduce strain on his or her wrist and significantly lessen the chance that he or she will injure the wrist. In addition, using the palm area of the hand to rotate the handle 14 (and therefore the brush head 12) takes strain away from the hairstylist's thumb. As with conventional cylindrical hairbrushes, the density and texture of the person's hair will affect how much work is required to rotate the brush head 12. However, instead of utilizing his or her wrist, thumb and index finger, as necessary to turn a conventional cylindrical hairbrush, the new hairbrush 10 allows the hairstylist to take advantage of the fact that his or her hand is much stronger and, therefore, much less likely to be strained, which can lead to fatigue or injury of the wrist. Rotation of the sleeves 46 of handle assemblies 40/42 in the hairstylist's hand will cause the brush head 12 to rotate in the person's hair, thereby allowing the hairstylist to quickly, easily, effectively and relatively painlessly accomplish the brushing and/or styling objectives for which the hairbrush 10 is utilized without putting strain on the hairstylist's wrist, thumb and fingers.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A hairbrush, comprising:

a brush head having a head body with a plurality of bristles extending outwardly from said head body, said head body having a first end and a second end, said first end of said head body defining a first end of said hairbrush; and a handle having a first end and a second end, said first end of said handle at said second end of said head body of said brush head, said second end of said handle defining a second end of said hairbrush, said handle comprising a first handle assembly and a second handle assembly in spaced apart relation to said first handle assembly so as to define a gap therebetween, each of said first handle assembly and said second handle assembly having a rod member and a tubular sleeve disposed around said rod member, each of said first handle assembly and said second handle assembly structured and arranged for said rod member to be fixedly associated with said head body and for said sleeve to rotate relative to said rod member, wherein rotation of each of said first handle assembly and said second handle assembly by a palm area of a hand of a hairstylist will rotate said brush head so as to allow the hairstylist to brush and/or style a person's hair without strain on a thumb and/or one or more fingers of the hairstylist.

2. The hairbrush of claim 1, wherein said head body of said brush head has an elongated cylindrical shape with said bristles being disposed substantially along the length and circumference of said head body.

3. The hairbrush of claim 2, wherein said head body has an elongated head axis and said handle is configured to define an elongated handle axis, said elongated head axis and said elongated handle axis defining a longitudinal brush axis through said hairbrush.

4. The hairbrush of claim 1, wherein said each of said rod members are elongated and define an elongated rod axis, said elongated rod axis of said first handle assembly being parallel to and in spaced apart relation to said elongated rod axis of said second handle assembly, said rod axis of said first handle assembly and said second handle assembly being parallel to and spaced apart from a longitudinal brush axis through said head body and said handle.

5. The hairbrush of claim 1 wherein said rod member of each of said first handle assembly and said second handle assembly is integral with or attached to said head body of said head brush.

6. The hairbrush of claim 5, wherein each of said rod members are attached to or integral with a base of said head body.

7. The hairbrush of claim 1 further comprising a first connector, said first connector structured and arranged to interconnect said first end of said handle with said second end of said head body.

8. The hairbrush of claim 7, wherein said first connector attaches each of said rod members of said first handle assembly and said second handle assembly with a base of said head body.

9. The hairbrush of claim 1 further comprising a second connector disposed at or near said second end of said handle, said second connector structured and arranged to join said first handle assembly and said second handle assembly.

10. The hairbrush of claim 9, wherein said second connector is configured to connect said rod member of said first handle assembly to said rod member of said second handle assembly.

11. A hairbrush, comprising:

a brush head having an elongated cylindrically-shaped head body with a plurality of bristles extending outwardly from said head body, said head body having a first end, a second end and a longitudinal head axis through said head body, said first end of said head body defining a first end of said hairbrush; and an elongated handle having a first end, a second end and an elongated handle axis through said handle, said elongated head axis and said elongated handle axis defining a longitudinal brush axis through said hairbrush, said first end of said handle at said second end of said head body of said brush head, said second end of said handle defining a second end of said hairbrush, said handle comprising a first handle assembly and a second handle assembly in spaced apart relation to said first handle assembly so as to define a gap therebetween, each of said first handle assembly and said second handle assembly having an elongated rod member and an elongated tubular sleeve disposed around said rod member, each of said first handle assembly and said second handle assembly structured and arranged for said rod member to be fixedly associated with said head body and for said sleeve to rotate relative to said rod member, wherein rotation of each of said first handle assembly and said second handle assembly by a palm area of a hand of a hairstylist will rotate said brush head so as to allow the hairstylist to brush and/or style a person's hair without strain on a thumb and/or one or more fingers of the hairstylist.

12. The hairbrush of claim 11 wherein said rod member of each of said first handle assembly and said second handle assembly is integral with or attached to said head body of said head brush.

13. The hairbrush of claim 12, wherein each of said rod members are attached to or integral with a base of said head body.

14. The hairbrush of claim 11, wherein said each of said rod members define an elongated rod axis, said elongated rod axis of said first handle assembly being parallel to and in spaced apart relation to said elongated rod axis of said second handle assembly, said rod axis of said first handle assembly and said second handle assembly being parallel to and spaced apart from said longitudinal brush axis through said head body and said handle.

15. The hairbrush of claim 11 further comprising a first connector, said first connector structured and arranged to interconnect said first end of said handle with said second end of said head body.

16. The hairbrush of claim 15, wherein said first connector attaches each of said rod members of said first handle assembly and said second handle assembly with a base of said head body.

17. The hairbrush of claim 11 further comprising a second connector disposed at or near said second end of said handle, said second connector structured and arranged to join said first handle assembly and said second handle assembly.

18. A hairbrush, comprising:

a brush head having an elongated cylindrical head body with a plurality of bristles extending outwardly from said head body substantially along the length and circumference of said head body, said head body having a first end, a second end and a longitudinal head axis through said head body, said first end of said head body defining a first end of said hairbrush; and an elongated handle having a first end, a second end and an elongated handle axis through said handle, said elongated head axis and said elongated handle axis defining a longitudinal brush axis through said hairbrush, said first end of said handle at said second end of said head body of said brush head, said second end of said handle defining a second end of said hairbrush, said handle comprising a first handle assembly and a second handle assembly in spaced apart relation to said first handle assembly so as to define a gap therebetween, each of said first handle assembly and said second handle assembly having an elongated rod member and an elongated tubular sleeve disposed around said rod member, said rod member of each of said first handle assembly and said second handle assembly being integral with or attached to said head body of said head brush, each of said sleeves configured to rotate relative to said rod members; and a first connector interconnecting said first end of said handle with said second end of said head body, wherein rotation of each of said first handle assembly and said second handle assembly by a palm area of a hand of a hairstylist will rotate said brush head so as to allow the hairstylist to brush and/or style a person's hair without strain on a thumb and/or one or more fingers of the hairstylist.

19. The hairbrush of claim 18 further comprising a second connector disposed at or near said second end of said handle, said second connector structured and arranged to join said first handle assembly and said second handle assembly.

20. The hairbrush of claim 18, wherein said each of said rod members define an elongated rod axis, said elongated rod axis of said first handle assembly being parallel to and in spaced apart relation to said elongated rod axis of said second handle assembly, said rod axis of said first handle assembly and said second handle assembly being parallel to and spaced apart from said longitudinal brush axis through said head body and said handle.

* * * * *